United States Patent [19]

Boyd

[11] 4,203,417

[45] May 20, 1980

[54] FIREPLACE HEATER AND GRATE

[75] Inventor: Donald A. Boyd, Euclid, Ohio

[73] Assignee: Cardinal American Corporation, Cleveland, Ohio

[21] Appl. No.: 847,756

[22] Filed: Nov. 2, 1977

[51] Int. Cl.[2] ..... F23H 13/02

[52] U.S. Cl. ..... 126/165; 126/152 A; 126/121

[58] Field of Search ..... 126/121, 164, 165, 152 A, 126/152 B, 178, 180; 237/51; 110/298, 299, 300; 228/59

[56] References Cited

U.S. PATENT DOCUMENTS

| | | | |
|---|---|---|---|
| 99,582 | 2/1870 | Monnies | 126/152 A |
| D. 242,542 | 11/1976 | Batenbaugh, Jr. | 126/121 |
| 828,769 | 8/1906 | Parkinson | 126/180 X |
| 1,608,745 | 11/1926 | Holbek | 126/121 |
| 3,001,521 | 9/1961 | Reilly | 237/51 X |
| 3,945,369 | 3/1976 | Adams et al. | 126/164 |
| 4,008,703 | 2/1977 | Allgood | 237/51 X |
| 4,026,263 | 5/1977 | Boyd | 126/121 |
| 4,078,542 | 5/1978 | Young et al. | 126/164 |
| 4,122,825 | 10/1978 | Slate | 126/121 |

FOREIGN PATENT DOCUMENTS

| | | | |
|---|---|---|---|
| 16850 | of 1895 | United Kingdom | 126/152 A |
| 22671 | of 1895 | United Kingdom | 126/152 A |
| 119326 | 10/1918 | United Kingdom | 126/121 |
| 179812 | 5/1922 | United Kingdom | 126/121 |
| 545247 | 5/1942 | United Kingdom | 126/121 |

*Primary Examiner*—Edward G. Favors
*Assistant Examiner*—Harold Joyce
*Attorney, Agent, or Firm*—Isler and Ornstein

[57] ABSTRACT

A fireplace heater and grate is disclosed comprising a series of vertically-extending laterally spaced convection tubes having portions at their lower ends for passage therethrough of unheated air, and a rectangular grate of basket-like configuration for containing coal or like fuel for providing a fire for heating the air in said tube portions. The tube portions extend through the grate in heat-exchanging relationship with said fuel. Cast iron shields are provided which overlie and are in contact with said tube portions for protecting said tube portions from the corrosive and burning effects of said burning fuel. The shields are of semi-circular cross-section and have arcuate ends. The grate is supported by cast iron legs removably secured to the grate at the corners thereof.

5 Claims, 10 Drawing Figures

FIREPLACE HEATER AND GRATE

This invention relates, as indicated, to a fireplace heater and grate, but has reference more particularly to improvements in the fireplace heater and grate disclosed in Boyd patent application Ser. No. 637,234, filed Dec. 3, 1975.

The fireplace heater and grate disclosed in the aforesaid Boyd application is designed primarily for burning logs or wood, cold or unheated air being drawn into the bottom portions of the tubes and heated by the hot embers, the heated air being then forced upwardly through the tubes by convection, heated again by the fire, and blown out into the room.

The steel tubes of which the heater is made are of relatively light guage, but are able to withstand the intensity of heat of the fire developed by burning logs or wood.

However, at the present time, logs or wood, in any form, are in rather short supply, and obtainable at relatively high prices so that other more abundant sources of solid combustible material such as coal must be used for heating puposes.

In using coal or the like fuel for heating the air in the tubes or fireplace heaters of the aforesaid type, it has been found that the heat of the burning coal or like fuel is so intense as to corrode or burn the light guage steel tubes, thereby shortening the life of the heater.

While this would normally dictate the use, in such fireplace features, of tubes of heavy gauge steel, such an expedient is undesirable for many reasons, including the added cost of heavy gauge steel, the difficulty in bending tubes of heavy gauge steel to the desired configuration, the added cost of shipping the heater due to the increased weight, and the added difficulty of moving the heater into position in the fireplace.

The present invention, accordingly has as its primary object, the provision of a heater and grate of the character described, in which tubes of light gauge steel are employed, but in which provision is made for preventing or lessening the tendency of the tubes to become corroded or burned by the heat of the fire.

Another object of the invention is to provide a heater and grate of the character described, which is especially adapted for use with solid fuels, such as coal or the like.

Another object of the invention is to provide a heater of the character described having incorporated therein a heavy grate made of cast iron or like metal, and which is especially adapted for the burning therein of coal or like fuel.

A further object of the invention is to provide a heater of the character described, in which other means are provided for protecting the tubes against corrosion or burning.

A still further object of the invention is to provide a heater of the character described in which an improved heat-exchanging relationship between the burning fuel and the tubes is effected.

Other objects and advantages of my invention will be apparent during the course of the following description.

In the accompanying drawings forming a part of this specification, and in which like numerals are employed to designate like parts throughout the same, FIG. 1 is a top plan view of the fireplace heater and grate;

Figure 2:
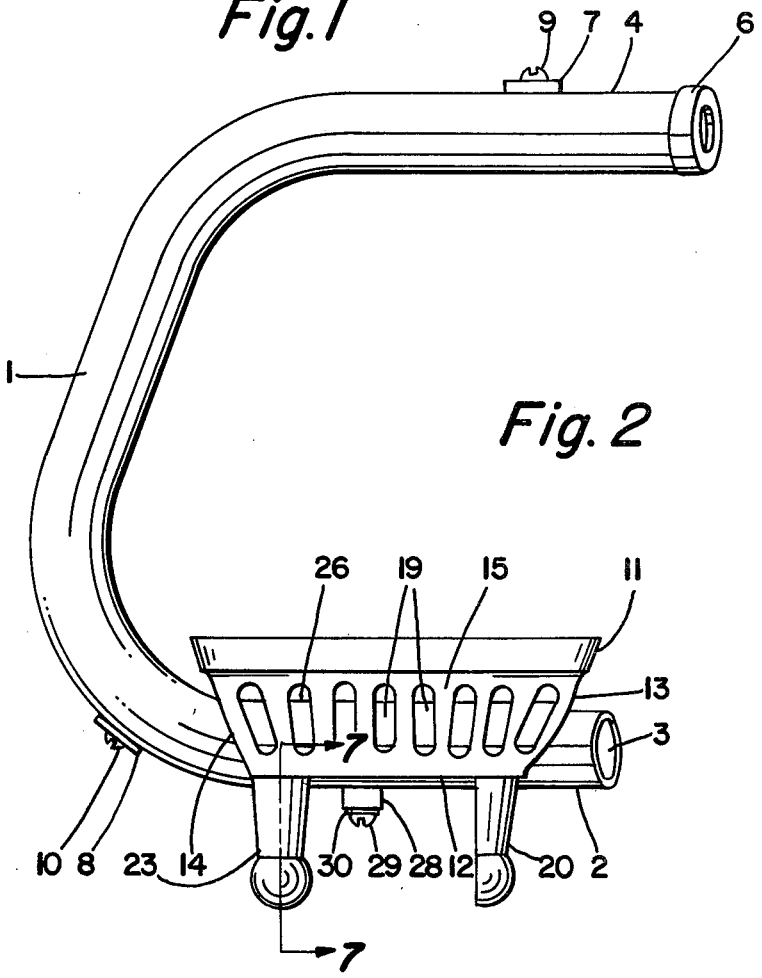
FIG. 2 is a side elevational view of the fireplace heater and grate, as viewed from the left end of FIG. 1.

Referring more particularly to the drawings, the fireplace heater and grate will be seen to comprise a series of convection tubes 1, perferably of steel and of uniform diameter, bent to the configuration shown in FIG. 2, to provide lower portions 2 having entrant openings 3, for unheated air, and upper portions 4, having open forward ends 5 for the exit of heated air from the tubes.

If desired, intensifier caps 6 may be slidably mounted on the forwardly directed ends of the tube portions 4, such caps being shown in Boyd patent application Ser. No. 637,234, filed Dec. 3, 1975.

Figure 1:
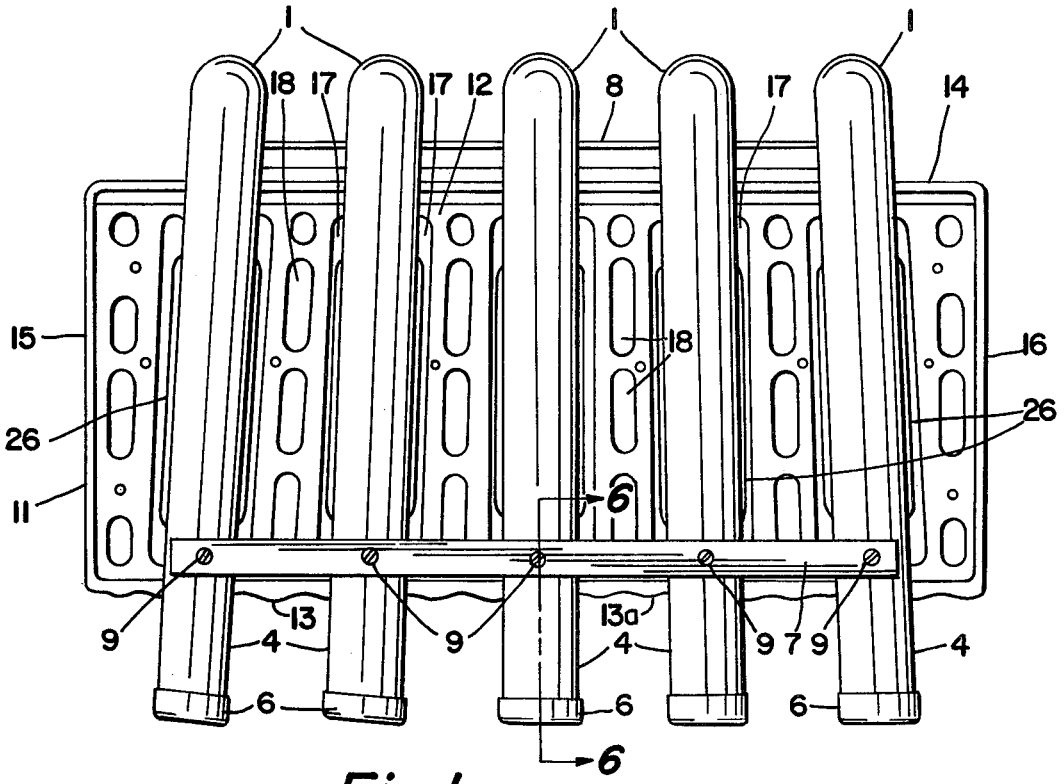
Figure 3:
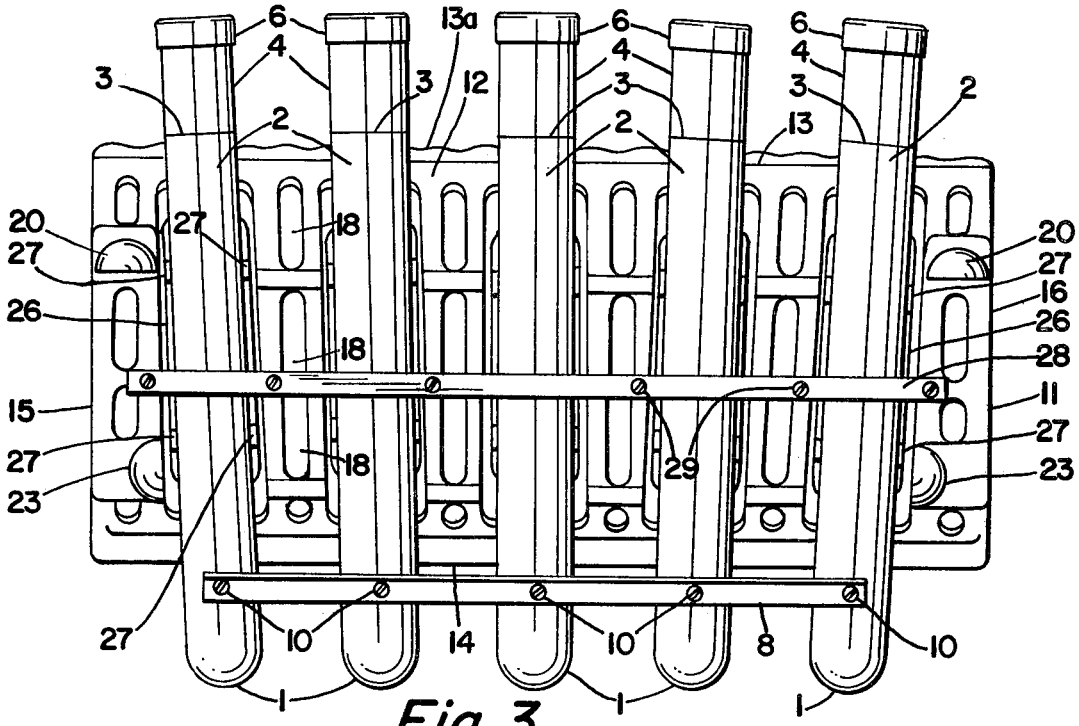
FIG. 3 is a bottom plan view of the fireplace heater and grate.
Figure 4:
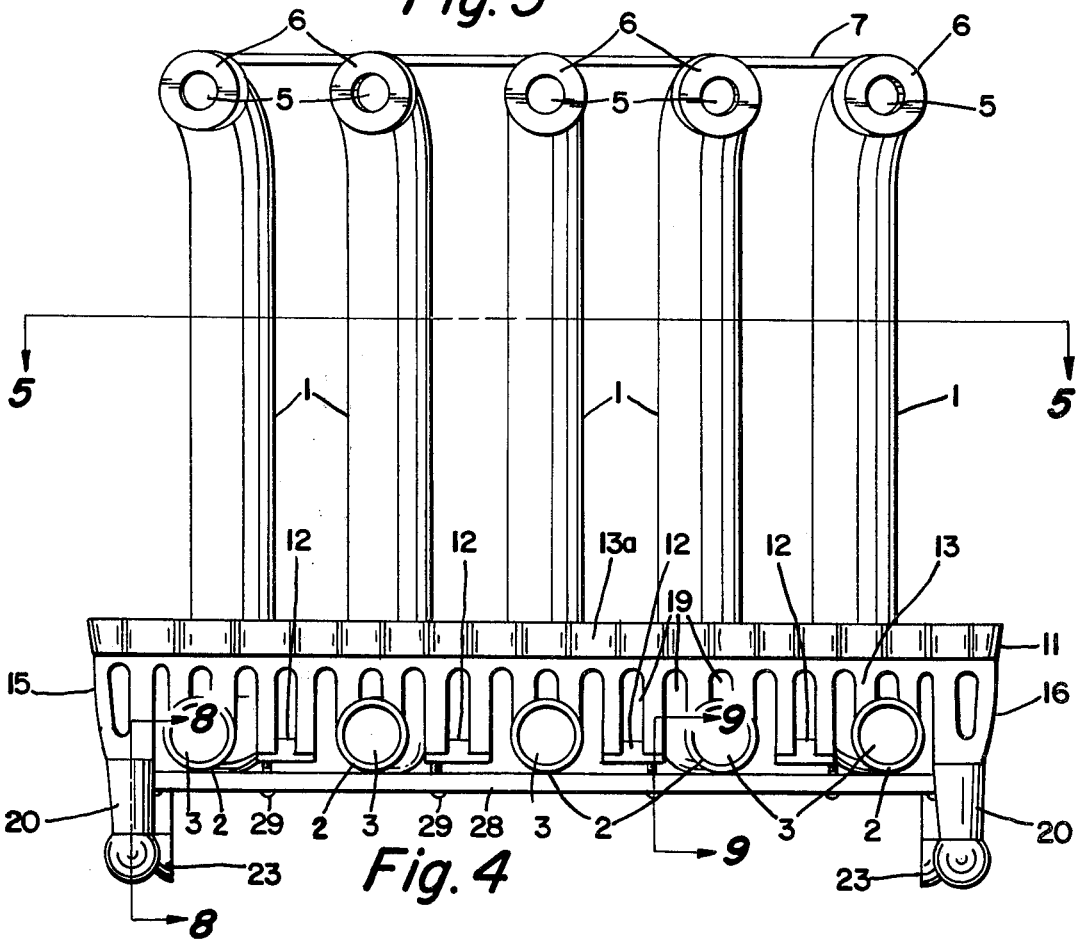
FIG. 4 is a front elevational view of the fireplace heater and grate.
Figure 5:
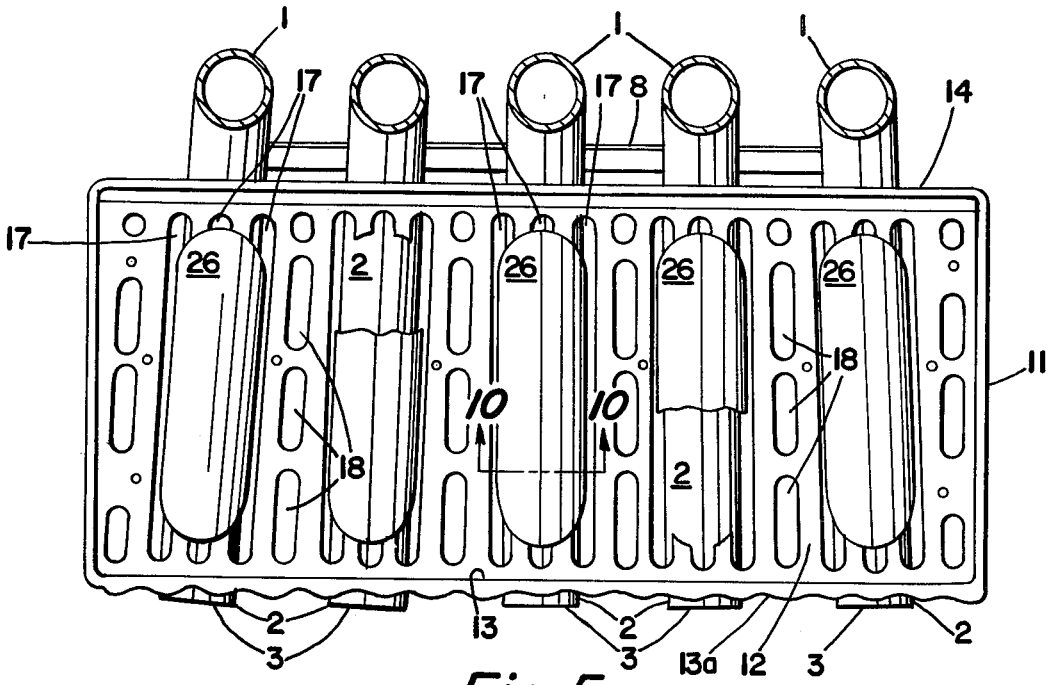
FIG. 5 is a cross-sectional view of the fireplace heater and grate, taken on the line 5—5 of FIG. 4.

The tubes 1 are maintained in slightly non-parallel or divergent relationship with each other in the manner shown in FIGS. 1, 3 and 5, by means of brackets or bars 7 and 8.

Figure 6:
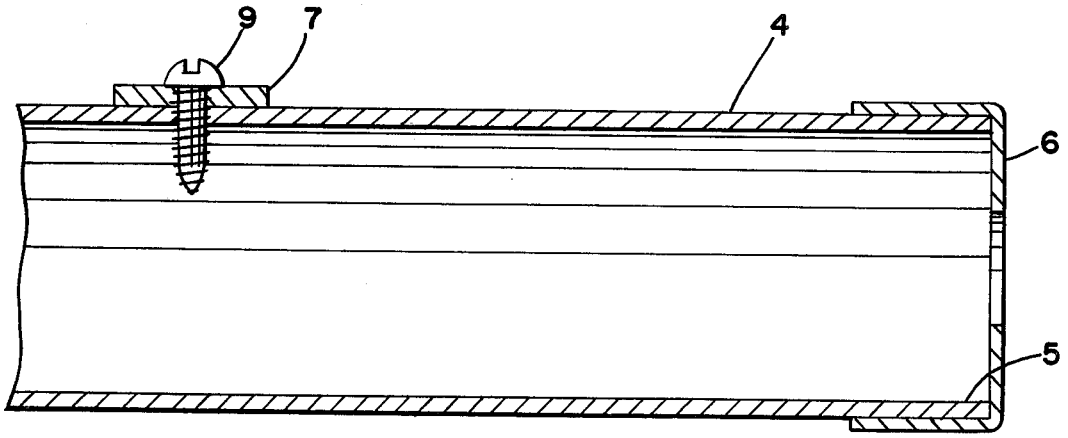
FIG. 6 is a fragmentary cross-sectional view, on an enlarged scale, taken on the line 6—6 of FIG. 1.
Figure 7:
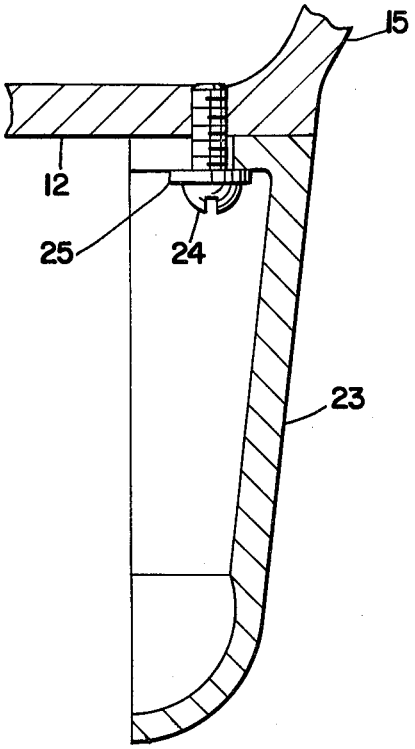
FIG. 7 is a fragmentary cross-sectional veiw on an enlarged scale, taken on the line 7—7 of FIG. 2
Figure 8:
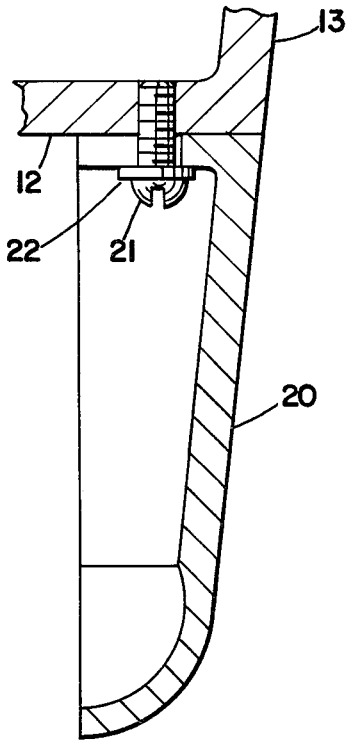
FIG. 8 is a fragmentary cross-sectional view, on an enlarged scale, taken on the line 8—8 of FIG. 4.
Figure 9:
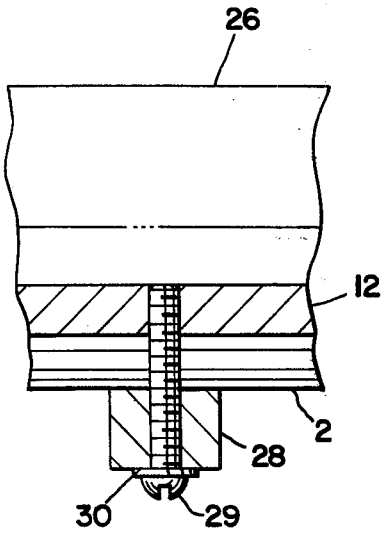
FIG. 9 is a fragmentary cross-sectional view, on an enlarged scale, taken on the line 9—9 of FIG. 4.

The bracket or bar 7 is secured to the upper portions 4 of the tubes 1 by means of self-tapping screws 9 (see FIG. 6), while the bracket or bar 8 is secured to the tubes 1 by means of similar self-tapping screw 10 (see FIGS. 2 and 3).

The fireplace heater and grate includes, as a unitary part thereof, a fuel holder or grate generally designated by reference numeral 11, and preferably made in one piece, of a relatively heavy cast iron casting.

The fuel holder or grate 11 is of rectangular basket-like form or configuration, consisting of a flat bottom 12, a front or forward wall 13, a rear or back wall 14, and end walls 15 and 16. The front 13 wall, as best seen in FIGS. 1, 3, 4 and 5, has an upper marginal front face 13*a*, which is of scalloped configuration, to aid in strengthening the wall 13.

The bottom 12 of the grate 11 is provided at laterally-spaced areas, with elongated slots or openings 17, which serve to permit ashes and embers to drop from the grate as well as to permit air into the grate for combustion puposes.

The areas of the grate bottom 12 intermediate the areas in which the slots or openings 17 are disposed, are provided with aligned slots or openings 18, which also serve to permit ashes and embers to drop from the grate, as well as to permit air into the grate for combustion purposes.

The front wall 13, rear wall 14, and end walls 15 and 16 are provided with elongated slots 19, through which air enters the grate for aiding in the combustion of the coal or like fuel which is placed in the grate.

As best seen in FIGS. 2, 3, 4 and 8, cast iron legs 20 are provided for supporting the forward portion of the grate 11, these legs being secured to the bottom 12 of the grate by means of screw bolts 21, and washers 22.

As best seen in FIGS. 2, 3, 4 and 7, cast iron legs 23 are provided in supporting the rear portion of the grate 11, these legs being secured to the bottom 12 of the grate by means of screw bolts 24 and washers 25.

Figure 10:
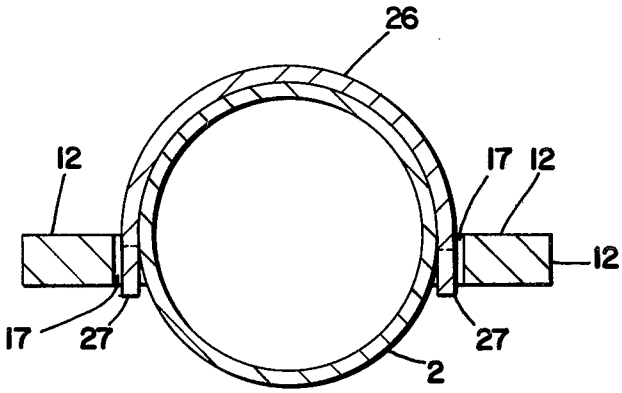
FIG. 10 is a fragmentary cross-sectional view, on an enlarged scale, taken on the line 10—10 of FIG. 5.

For the purpose of protecting the lower portions 2 of the tubes 1 from being corroded or burned by the intense heat of the fire in the grate 11, cast iron shields 26 are provided, which, as best seen in FIGS. 1, 2, 3, 5, 9 and 10, are of semi-circular cross-section, conforming to the curvature of the portions 2 of the tubes 1, and rest on such portions of the tubes (see FIG. 10).

The shields 26 have arcuate-shaped ends (see FIG. 5), and are provided at each of their lower edges with spaced tabs or ears 27 (see FIGS. 3 and 10) which extend downwardly into the slots or openings 17 of the bottom 12 of the grate, to thereby aid in preventing lateral displacement of the shields.

As seen in FIG. 5, portions of the grate bottom 12, between the slots or openings 17 are removed to receive or accommodate the arcuate ends of the shields 26.

As best seen in FIGS. 2, 3, 4 and 9, the portions 2 of the tubes 1 extend through the back wall 14 and front wall 13 of the grate 11, and are supported against displacement from the grate by means of a bar or bracket 28, which extends substantially tangentially of the portions 2 of the tubes, and is secured to the bottom 12 of the grate by means of screw bolts 29 and washers 30.

In the use of the fireplace heater and grate, fuel such as coal or the like is placed in the grate, filling the spaces between the shields 26 and to a depth such as to overlie the shields 26.

The intense heat of the burning coal will heat the air passing into and through the portions 2 of the tubes 1, the heated air passing upwardly through the tubes 1 and out through the portions 4 of the tubes and through the caps 6. As the heated air passing through the portions 4 of the tubes, it is additionally heated by the heat of the fire in the grate.

At the same time the shields 26 will protect the portions 2 of the tubes 1 from corrosion or burning by the coal fire in the grate.

Moreover, the fact that the grate and shields 26 are made of cast iron in contrast with grates made of expanded metal and the like, which are presently used in fireplace heaters of this type, insures long life for the grate, and this long life is also assured by the fact that the shields 26 protect the tubes 1 during use of the heater.

Since the shields 26 extend upwardly into the interior of the grate, the sloping surfaces of the shields 26 facilitate gravity movement of the coal into the spaces between the shields and thus descent of the embers and ashes into and through the openings 17.

Due to the basket-like configuration of the grate 11, the fire in the grate is concentrated, so as to confine the heat towards the portions 2 of the tubes 1, thereby substantially increasing the overall heating efficiency of the heater.

It is to be understood that the form of my invention, herewith shown and described, is to be taken as a preferred example of the same, and that various changes may be made in the shape, size and arrangement of parts thereof, without departing from the spirit of the invention or the scope of the subjoined claims.

Having thus described my invention, I claim:

1. In combination with a fireplace heater comprising a series of vertically-extending laterally spaced convection tubes having air inlet lower portions and air outlet upper portions, a grate of basket-like configuration having supporting legs adapted to support said grate in spaced relation to the floor of a fireplace, said grate having upstanding front and back walls, said lower portions of said tubes extending through said front and back walls, and being in heat-exchanging relationship with fuel in said grate, and means for securing said grate to said tubes, said means comprising a bar or bracket extending substantially tangentially of the lower portions of said tubes.

2. The combination, as defined in claim 1, wherein said securing means includes screwbolts extending through said bar or bracket and threadedly secured to said grate.

3. The combination, as defined in claim 1, wherein means are provided for covering said lower portions of said tubes for preventing corrosion or burning of said lower tube portions by burning fuel in said grate, said covering means comprising metal shields of semi-circular cross-section overlying and conforming to the cross-sectional curvature of said lower portions of the tubes.

4. The combination, as defined in claim 3, wherein said grate has openings therein, and said shields have tabs or ears extending therefrom and into said openings for preventing lateral displacement of said shields.

5. The combination, as defined in claim 1, wherein said supporting legs are removably secured to said grate adjacent the corners of said grate.

* * * * *